US006276452B1

(12) United States Patent
Davis et al.

(10) Patent No.: US 6,276,452 B1
(45) Date of Patent: Aug. 21, 2001

(54) APPARATUS FOR REMOVAL OF MILLING DEBRIS

(75) Inventors: John Phillip Davis, Cypress, TX (US); Terry Edgar Cassel, Princeton, LA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/434,665

(22) Filed: Nov. 5, 1999

Related U.S. Application Data

(62) Division of application No. 09/038,782, filed on Mar. 11, 1998, now abandoned.

(51) Int. Cl.[7] ..... E21B 29/00; E21B 31/08; E21B 37/00

(52) U.S. Cl. ..... 166/298; 166/55.1; 166/55.6; 166/99; 166/107; 166/312; 166/376; 175/312

(58) Field of Search ..... 166/55.1, 55.6, 166/99, 105.1, 105.4, 107, 158, 169, 222, 298, 311, 312, 376; 175/308, 312, 314

(56) References Cited

U.S. PATENT DOCUMENTS

| | | | | |
|---|---|---|---|---|
| 1,524,471 | * | 1/1925 | Benckenstein | 175/312 |
| 2,606,620 | * | 8/1952 | Deely | 166/99 |
| 2,609,182 | * | 9/1952 | Arutunoff | 175/312 X |
| 2,663,370 | | 12/1953 | Donnell et al. | 166/99 |
| 2,681,110 | * | 6/1954 | Harrison | 166/55.1 |
| 2,743,084 | * | 4/1956 | Arutunoff | 175/308 X |
| 2,797,755 | | 7/1957 | Bobo | 166/99 |
| 2,819,038 | * | 1/1958 | Eckel | 175/308 X |
| 2,890,756 | * | 6/1959 | Middleton | 166/99 |
| 2,920,872 | * | 1/1960 | Baur et al. | 175/312 X |
| 3,023,810 | | 3/1962 | Anderson | 166/99 |
| 3,102,600 | * | 9/1963 | Jackson | 175/308 |
| 3,120,872 | * | 2/1964 | Anderson | 175/312 X |
| 3,198,256 | | 8/1965 | Kirby, II | 166/99 |
| 4,060,140 | * | 11/1977 | Barrington | 175/312 X |
| 4,493,383 | * | 1/1985 | Williams et al. | 166/105.1 X |
| 5,176,208 | | 1/1993 | Lalande et al. | 166/99 |
| 5,295,537 | * | 3/1994 | Trainer | 166/105.1 |
| 5,402,850 | | 4/1995 | Lalande et al. | 166/301 |
| 5,682,950 | * | 11/1997 | Bjornstad | 166/99 |

FOREIGN PATENT DOCUMENTS

| | | |
|---|---|---|
| 0 430 536 A2 | 6/1991 | (EP) . |
| 1 363 192 | 8/1974 | (GB) . |
| 2 287 051 | 9/1995 | (GB) . |

OTHER PUBLICATIONS

*Combination Ball Type Jet and Junk Basket*; Baker Oil Tools Catalog; 1997; p. 29.

*Hydraulic Junk Basket*; Baker Oil Tools Catalog; 1997; p. 28.

*Jet Bushing and Internal Boot Basket*; Baker Oil Tools Catalog; 1997; p. 30.

*M Reverse Circulating Tool*; Baker Oil Tools Catalog; 1997; p. 31.

* cited by examiner

*Primary Examiner*—George Suchfield
(74) *Attorney, Agent, or Firm*—Gerald W. Spinks

(57) ABSTRACT

An apparatus and method for drawing small milling debris into a combination milling and debris retrieval tool, during the performance of the milling operation. A milling tool has a fluid intake port near its lower end, where debris-laden fluid is drawn into the milling tool and subsequently into a separator section. The separator section has a debris deflection tube and a screen for separating the debris from the fluid. Fluid is drawn into the tool by either a set of eductor nozzles or a downhole motor and pump.

7 Claims, 2 Drawing Sheets

APPARATUS FOR REMOVAL OF MILLING DEBRIS

CROSS REFERENCE TO RELATED APPLICATIONS

This application is a divisional of U.S. Ser. No. 09/038,782, filed Mar. 11, 1998, now abandoned.

STATEMENT REGARDING FEDERALLY SPONSORED RESEARCH OR DEVELOPMENT

Not Applicable

BACKGROUND OF THE INVENTION

1. Field of the Invention

This invention is in the field of equipment used to mill away metal objects downhole in a well bore, and equipment used to remove from the well bore the cuttings resulting from this milling.

2. Background Information

When a metal object, such as a section of casing, a packer, or a lost tool, is to be removed from a well bore, the best method of removal is often to mill the object into small cuttings with a mill such as a pilot mill, a section mill, or a junk mill, and then to remove the cuttings from the well bore. Furthermore, a milling tool will often result in the removal of scale, cement, or formation debris from a hole.

It is important to remove the cuttings, or other debris, because other equipment subsequently used in the well bore may incorporate sealing surfaces or elastomers, which could be damaged by loose metal cuttings being left in the hole. Most commonly, the metal cuttings and other debris created by milling are removed from the well bore by circulating fluid down the inside of the workstring and out openings in the milling tool, then up the annulus to the surface of the well site. This "forward circulation" method usually leaves some cuttings or debris stuck to the side of the well casing or well bore surface, and these cuttings or debris can damage some of the tools which may subsequently be run into the hole. Also, safety devices such as blow-out preventers usually have numerous cavities and crevices in which the cuttings can become stuck, thereby detracting from the performance of the device or possibly even preventing its operation. Removal and clean-out of such safety devices can be extremely expensive, often costing a quarter of a million dollars or more in the case of a deep sea rig. Further, rapid flow of debris-laden fluid through the casing can even damage the casing surface. Nevertheless, in applications where a large amount of metal must be removed, it is usually necessary to mill at a relatively fast rate, such as 15 to 30 feet of casing per hour. These applications call for the generation of relatively large cuttings, and these cuttings must be removed by the aforementioned method of "forward circulation", carrying the metal cuttings up to the well site surface via the annulus.

In some applications, such as preparation for the drilling of multiple lateral well bores from a central well bore, it is only necessary to remove a relatively short length of casing from the central bore, in the range of 5 to 30 feet. In these applications, the milling can be done at a relatively slow rate, generating a somewhat limited amount of relatively small cuttings. In these applications where a relatively small amount of relatively small cuttings are generated, it is possible to consider removal of the cuttings by trapping them within the bottom hole assembly, followed by pulling the bottom hole assembly after completion of the milling operation. The advantage of doing so is that the cuttings are prevented from becoming stuck in the well bore or in a blow-out preventer, so the risk of damage to equipment is avoided.

Some equipment, such as the Baker Oil Tools combination ball type Jet and junk basket, product number 130-97, rely upon reverse circulation to draw large pieces of junk into a downhole junk removal tool. This product has a series of movable fingers which are deflected by the junk brought into the basket, and which then catch the larger pieces of junk. An eductor jet induces flow into the bottom of the junk basket. This tool is typical, in that it is generally designed to catch larger pieces of junk which have been left in the hole. It is not effective at removing small debris, because it will generally allow small debris to pass back out through the basket.

Moreover, the ability of this tool to pick up debris is limited by the fluid flow rate which can be achieved through the workstring, from a pump at the well site. In applications where the tool must first pass through a restricted diameter bore, to subsequently operate in a larger diameter bore, the effectiveness of the tool is severely limited by the available fluid flow rate. Additionally, if circulation is stopped, small debris can settle behind the deflecting fingers, thus preventing them from opening all the way. Further, if this tool were to be run into a hole to remove small cuttings after a milling operation, the small cuttings would have settled to the bottom of the hole, making their removal more difficult. In fact, this tool is provided with coring blades for coring into the bottom of the hole, in order to pick up items which have settled to the bottom of the hole.

Another type of product, such as the combination of a Baker Oil Tools jet bushing, product number 130-96, and an internal boot basket, product number 130-21. uses a jet action to induce fluid flow into the tool laden with small debris. The internal boot basket creates a circuitous path for the fluid, causing the debris to drop out and get caught on internal plates. An internal screen is also provided to further strip debris from the fluid exiting the tool. The exiting fluid is drawn by the jet back into the annulus surrounding the tool. However, here as before, if this tool were to be run into a hole to remove small cuttings after a milling operation, the small cuttings would have settled to the bottom of the hole, making their removal more difficult. Furthermore, here again, the ability of this tool to pick up debris is limited by the fluid flow rate which can be achieved through the workstring.

Another known design is represented by the Baker Oil Tools Model M reverse circulating tool, which employs a packoff cup seal to close off the wellbore between fluid supply exit ports and return fluid exit ports. A reverse circulating flow is created by fluid supply exit ports introducing fluid into the annulus below the packoff cup seal, which causes fluid flow into the bottom of an attached milling or washover tool. This brings fluid laden with debris into the central bore of the reverse circulating tool, to be trapped within the body of the tool. The reverse circulating fluid exits the body of the tool through return fluid exit ports above the packoff cup seal and flows to the surface of the well site via the annulus. This tool relies upon the separation of the supply fluid and the return fluid, by use of the packoff cup seal between the fluid supply exit ports and return fluid exit ports. To avoid damage to this cup during rotation of the tool, the packoff cup seal must be built on a bearing assembly, adding significantly to the cost of the tool. Additionally, here as before, the ability of this tool to pick up debris is limited by the fluid flow rate which can be achieved through the workstring.

It is an object of the present invention to provide a tool which incorporates a milling tool, which will pick up and retain all of the small cutting debris generated by the milling tool, during milling operations, thereby avoiding the necessity to pick up small cuttings from the bottom of the hole. It is a further object of the present invention to provide a tool which will pick up and retain small cutting debris generated by a milling tool, without the need for a packoff cup seal or other device susceptible to damage by rotation. It is a still further object of the present invention to provide a tool which will generate a high reverse circulation flow rate at the bottom hole assembly, even when the flow rate available through the workstring, from a pump at the well site, is limited.

BRIEF SUMMARY OF THE INVENTION

The present invention is a tool for separating small cutting debris from fluid flow at the bottom hole assembly, during operation of an incorporated milling tool, and for capturing the small debris within the housing of the separator tool. The separator tool relies on a plurality of supply fluid exit ports through the wall of the separator housing into the annulus. In one embodiment, the supply fluid is directed through the supply fluid exit ports by a plurality of high speed eductor jets. The eductor fluid is supplied to the eductor jets by pumping fluid from the surface of the well site through a workstring to which the separator tool is attached. The eductor jets pull a vacuum within the separator tool housing, thereby inducing "reverse circulation" flow of debris-laden fluid into the separator tool through a milling tool attached to the bottom of the separator tool.

The induced fluid flow is directed through a deflector tube to reduce the velocity of the fluid and to deflect debris which has been brought into the deflector tube, allowing the debris to drop into an annular area around the deflector tube. The stripped fluid exits the tool by flowing through a screen back to the eductor jets, and thence back down through the annulus toward the milling tool. Excess fluid pumped from the surface returns uphole to the surface through the annulus.

In an alternative embodiment, the bottomhole reverse circulation flow is created by a downhole mud motor which drives a downhole pump. The pump circulates bottomhole fluid through exit ports and down through the annulus to the area adjacent to the milling tool, where the bottomhole fluid enters the milling tool carrying small debris. The debris is separated from the fluid as described above. Drive fluid is pumped down to the mud motor through the workstring, by a pump at the surface. Drive fluid exiting the mud motor flows through exit ports in the tool housing, to return to the surface via the annulus. It is not necessary to separate the drive fluid from the bottomhole fluid, because the bottomhole fluid in the annulus is kept clean by the separator tool. This embodiment can create a bottomhole fluid circulation rate at least five times the circulation rate achievable through the workstring.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
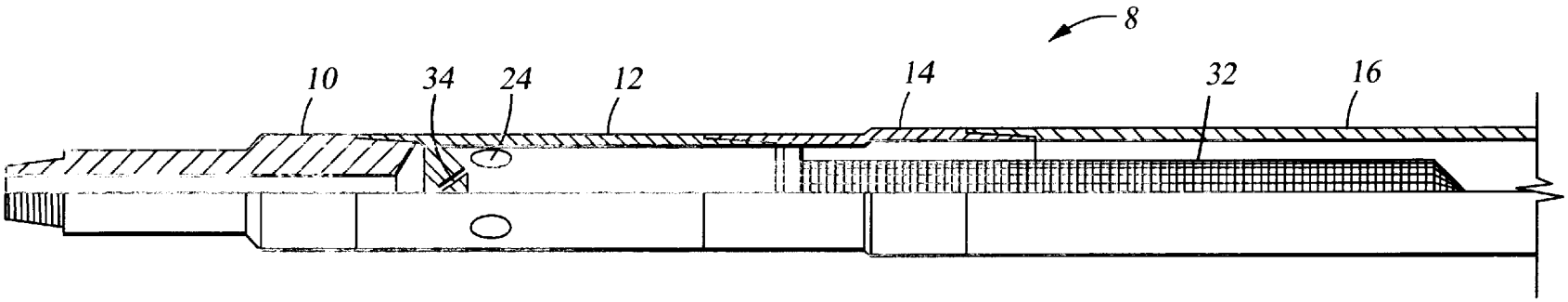
FIG. 1 is a longitudinal section of the upper end of a first embodiment of the tool according to the present invention.
Figure 2:
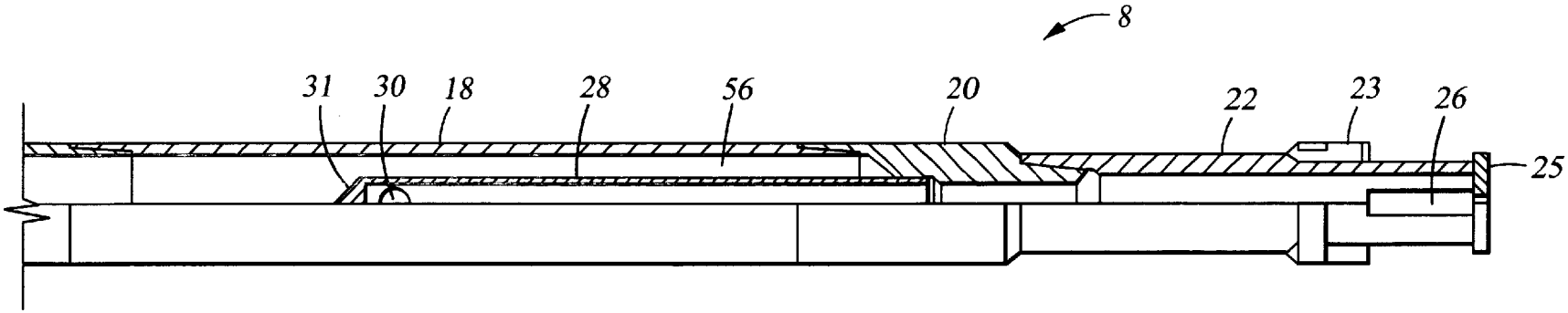
FIG. 2 is a longitudinal section of the lower end of the first embodiment shown in FIG. 1.

As shown in FIGS. 1 and 2, a rotating tool 8 according to the present invention has a drive sub 10 at its upper end, a plurality of sections of wash pipe 12, 16, 18 connected to the drive sub 10, a screen crossover 14 and a triple connection sub 20 connected to the wash pipe, and a milling tool 22 connected to the lower end of the triple connection sub 20. The drive sub 10 is adapted to connect to a rotating workstring (not shown) or to a downhole motor (not shown) connected to a non-rotating workstring, such as coiled tubing, by means such as a threaded connection. The sections of wash pipe 12, 16, 18, the screen crossover sub 14, and the triple connection sub 20 serve as a separator housing. The uppermost wash pipe ejection port section 12, which is threaded to the drive sub 10, incorporates a plurality of supply fluid exit or ejection ports 24 penetrating the wall of the wash pipe section 12 at spaced intervals. The screen crossover sub 14, which is threaded to the ejection port section 12, serves to hold a tubular filter screen 32 in place below the ejection ports 24, with the screen 32 extending downwardly toward the milling tool 22 at the lower end of the apparatus. A first wash pipe extension section 16 can be threaded to the screen crossover sub 14, if necessitated by the length of the screen 32. A second wash pipe extension section 18 is threaded to the first extension section 16. The triple connection sub 20 is threaded to the lower end of the second extension section 18.

The milling tool 22 is threaded to the lower end of the triple connection sub 20. A plurality of blades 23 are positioned at intervals about the periphery of the milling tool 22 for milling metal items, such as casing or liner pipe, from the well bore. The lower end of the milling tool 22 can have a drift plate 25, which has a diameter close to the inside diameter of the bore hole in which the milling tool 22 will be used. The drift plate 25 serves to prevent metal cuttings from falling down the bore hole. One or more intake slots or ports 26 are provided in the lower end of the milling tool 22 below the blades 23. In applications where the stuck pipe is not concentrically positioned in the casing or well bore, it has been found that the drift plate 25 can break loose, so in such applications, a milling tool 22 without the drift plate 25 is used, and a single intake port is located at the bottom of the milling tool 22, instead of a plurality of slots 26.

Importantly, a debris deflector tube 28 is threaded into an interior thread in the triple connection sub 20, extending upwardly from the triple connection sub 20 toward the screen 32. A plurality of side ports 30 are provided through the wall of the deflector tube 28. A deflector plate 31 is provided in the upper end of the deflector tube 28 to deflect any metal cuttings or other debris which might be carried by fluid flowing through the deflector tube 28, and to separate the debris from the fluid. Alternatively, other means of separating the debris from the fluid can be used, such as deflection plates within the deflector tube 28 to create a spiral fluid flow, thereby separating the heavy debris from the fluid.

Another important feature of the deflector tube 28 is that its reduced diameter facilitates movement of the cuttings along with the fluid, up to the point of separation of the cuttings from the fluid for deposit in a holding area. In a representative example, the body of the tool might have a nominal diameter of 7⅝ inches, with the deflector tube 28 having a nominal diameter of 2⅜ inches. It has been found that a fluid flow velocity of approximately 120 feet per minute is required to keep the cuttings moving along with the fluid, depending upon the fluid formulation. This flow velocity can be achieved in the exemplary deflector tube 28 with a fluid flow rate of only about ½ barrel per minute. If a reverse circulation tool without the deflector tube 28 were employed, a fluid flow rate of about 6 barrels per minute would be required to keep the cuttings moving. Put another way, if a reverse circulation tool were not used, with forward circulation instead being relied upon to move the cuttings all the way to the surface via the annulus, a fluid flow rate of 4 to 10 barrels per minute, or even more, would be required. This means that use of the tool of the present invention allows the use of smaller pumps and motors at the well site surface, and use of cheaper formulations of fluid.

In the first embodiment of the present invention, as shown in FIG. 1, a plurality of high speed supply fluid eductor nozzles 34 are provided in the wash pipe ejection port section 12, with each eductor nozzle 34 being aligned with one of the ejection ports 24, at a downward angle. As the tool 8 is rotated to mill away the metal item from the well bore with the milling tool 22, fluid is pumped by a pump (not shown) at the surface of the well site down through the workstring (not shown). The fluid flows from the workstring through the drive sub 10, and then through the eductor nozzles 34. Since the eductor nozzles 34 have restricted flow paths, they create a high speed flow of fluid, which is then directed downwardly through the ejection ports 24. As the high speed fluid flows out of the eductor nozzles 34 and through the ejection ports 24, it creates an area of low pressure, or vacuum, in the vicinity of the eductor nozzles 34, within the ejection port section 12 of the separator housing.

This area of low pressure or vacuum in the ejection port section 12 draws fluid up through the intake ports 26 of the milling tool 22, through the deflector tube 28, and through the screen 32. The fluid thusly drawn upwardly then passes out through the ejection ports 24 to the annulus surrounding the separator housing, to flow downwardly toward the milling tool 22. Excess fluid supplied via the workstring can also flow upwardly through the annulus toward the surface of the well site, to return to the pump.

As fluid flows past the milling tool blades 23, it entrains small cuttings or debris generated as the blades mill away the casing or other metal item. This debris-laden fluid then enters the intake ports 26 at the lower end of the milling tool 22 and passes into the interior of the deflector tube 28 within the wash pipe extension section 18. As the debris-laden fluid exits the side ports 30 in the deflector tube 28, the debris, which is heavier than the fluid, tends to separate from the fluid and settle into an annular area 56 between the deflector tube 28 and the wash pipe extension section 18.

The fluid, which may still contain very fine debris, then flows upwardly to contact the inlet side of the screen 32. As the fluid flows through the screen 32, the fine debris is removed by the screen 32, remaining for the most part on the inlet side of the screen 32. Fluid leaving the outlet side of the screen 32 then flows upwardly to the area of low pressure, or vacuum, in the vicinity of the eductor nozzles 34.

In most applications, this eductor nozzle embodiment of the invention will create a sufficient flow velocity to entrain virtually all of the small debris generated by the milling tool 22. In fact, it has been found that a 7⅝ inch tool according to the first embodiment creates a sufficient flushing action to remove the cutting debris from a milling operation within a 30 inch casing. However, in some applications, the flow rate which can be pumped downhole through the workstring may not be sufficient to entrain the milling debris. Such a situation arises when the fluid flow rate which can be created down the sides of the wash pipe is insufficient to entrain the milling debris as the fluid passes the blades 23. In this type of application, it can become necessary to use the second embodiment of the tool of the present invention, which incorporates a downhole motor and pump as the source of pressurized fluid, as illustrated in FIGS. 3 and 4.

Figure 3:
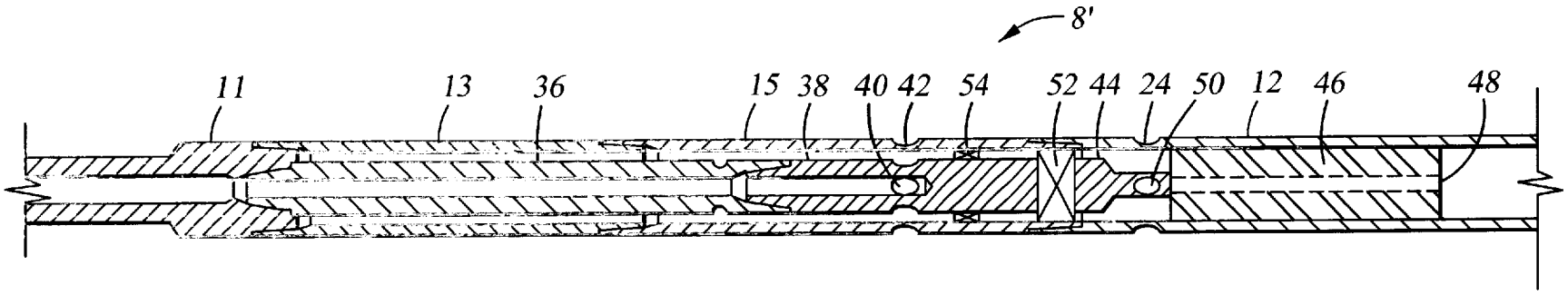
FIG. 3 is a longitudinal section of the upper end of a second embodiment of the tool according to the present invention, incorporating a downhole motor and pump.
Figure 4:
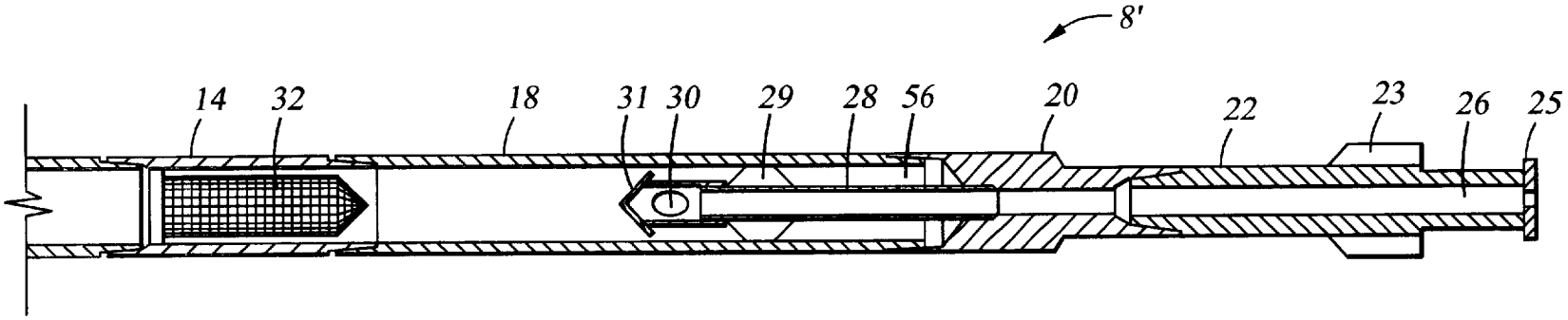
FIG. 4 is a longitudinal section of the lower end of the second embodiment shown in FIG. 3.

The separator apparatus 8' shown in FIGS. 3 and 4 has many elements similar to the apparatus 8 shown in FIGS. 1 and 2. That is, a plurality of ejection ports 24 penetrate the wall of the wash pipe ejection port section 12 at spaced intervals. The screen crossover sub 14 holds a tubular filter screen 32 in place below the ejection ports 24, with the screen 32 extending downwardly toward the milling tool 22 at the lower end of the apparatus. One or more wash pipe extension sections 18 are threaded to the screen crossover sub 14. The triple connection sub 20 is threaded to the lower end of the extension section 18.

The milling tool 22, identical to the milling tool used in the first embodiment, is threaded to the lower end of the triple connection sub 20. A debris deflector tube 28 is threaded into an interior thread in the triple connection sub 20, extending upwardly from the triple connection sub 20 toward the screen 32. Here as before, a plurality of side ports 30 are provided through the wall of the deflector tube 28, and a deflector plate 31 or a series of deflector plates are provided in the deflector tube 28. As FIG. 4 illustrates, a plurality of stabilizers 29 can be used in either embodiment to space the deflector tube 28 from the wash pipe.

The difference between the first embodiment and the second embodiment is that the second embodiment uses a downhole motor and downhole pump instead of eductor nozzles 34 to draw fluid upwardly through the tool. A drive sub 11 is connected to the workstring, and a motor housing section 13 of wash pipe is threaded to the lower end of the drive sub 11. A bearing housing section 15 of wash pipe is threaded to the lower end of the motor housing section 13. The motor housing section 13 houses a downhole motor 36, such as a mud motor, well known in the art. The downhole motor 36 drives a ported sub 38, which is housed in the bearing housing section 15. A bearing block 52 in the bearing housing section 15 supports the ported sub 38. The ported sub 38 drives a downhole pump 44, 46 in the ejection port section 12 of the wash pipe.

As the second embodiment of the tool 8' is rotated to mill away the metal item from the well bore with the milling tool 22, fluid is pumped by a pump (not shown) at the surface of the well site down through the workstring (not shown). The fluid flows from the workstring through the drive sub 11, and then through the downhole motor 36. Drive fluid exits the ported sub 38 via discharge ports 40, and exits the separator housing via drive fluid exit ports 42. Drive fluid supplied via the workstring flows upwardly through the annulus toward the surface of the well site, to return to the pump. An electric motor could be used instead of the mud motor, without departing from the spirit of the present invention.

The downhole motor 36 drives the downhole pump 44, 46 to draw bottomhole fluid into the inlet 48 of the downhole pump 44, 46. The bottomhole fluid is then discharged from a plurality of pump discharge ports 50, to exit the wash pipe ejection port section 12 via the ejection ports 24. A downhole motor driven by a fluid flow of 200 gpm can achieve a ported sub speed of 400 rpm. Turning the downhole pump at 400 rpm can easily produce a bottomhole recirculation rate of 1000 gpm. This high speed flow of bottomhole fluid is directed downwardly along the annulus surrounding the separator housing. An internal seal or packing 54 can be used to separate the drive fluid flow through the drive fluid exit ports 42 from the bottomhole fluid flow through the ejection ports 24.

As the downhole pump 44, 46 draws bottomhole fluid upwardly into the ejection port section 12 bottomhole fluid is drawn up through the intake ports 26 of the milling tool 22, through the deflector tube 28, and through the screen 32. The bottomhole fluid thusly drawn upwardly then passes out through the pump 44, 46 and the ejection ports 24 to the annulus surrounding the separator housing, to flow downwardly toward the milling tool 22.

As bottomhole fluid flows past the milling tool blades 23, it entrains small cuttings or debris generated as the blades mill away the casing or other metal item. This debris-laden fluid then enters the intake ports 26 at the lower end of the milling tool 22 and passes into the interior of the deflector tube 28 within the wash pipe extension section 18. As the debris-laden fluid exits the side ports 30 in the deflector tube 28, the debris, which is heavier than the fluid, tends to separate from the fluid and settle into an annular area 56 between the deflector tube 28 and the wash pipe extension section 18.

The fluid, which may still contain very fine debris, then flows upwardly to contact the inlet side of the screen 32. As the fluid flows through the screen 32, the fine debris is removed by the screen 32, remaining for the most part on the inlet side of the screen 32. Fluid leaving the outlet side of the screen 32 then flows upwardly to the inlet of the downhole pump.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. An apparatus for removing milling debris from a well bore during milling operations, said apparatus comprising:

a rotatable tubular separator housing, said separator housing being connectable to a lower end of a work string;

a milling tool connectable to a lower end of said separator housing;

at least one fluid ejection port through a wall of said separator housing, said at least one ejection port being positioned and adapted to eject fluid to an area of a well bore adjacent said separator housing;

at least one intake port on said milling tool, said at least one intake port being positioned and adapted to take in debris-laden fluid from an area of a well bore adjacent said milling tool;

a debris deflector tube within said separator housing, said debris deflector tube being in fluid flow communication between said at least one intake port in said milling tool and said at least one fluid ejection port: and a downhole pump positioned and adapted to pump debris-laden fluid from said at least one intake port, through said debris deflector tube, to said at least one fluid ejection port.

2. An apparatus as recited in claim 1, wherein said debris deflector tube comprises:

an inlet connected in fluid flow communication with said at least one intake port in said milling tool;

an end cap on said deflector tube for deflecting debris; and at least one side port on said deflector tube for directing debris-laden fluid to an annular space between said deflector tube and said separator housing.

3. An apparatus as recited in claim 1, further comprising a downhole motor connected to the workstring, said downhole pump being driven by said downhole motor.

4. An apparatus as recited in claim 3, further comprising a surface pump at the well site for pumping fluid downhole through the workstring to said downhole motor, wherein said downhole motor is a fluid driven motor.

5. An apparatus as recited in claim 1, further comprising a screen within said separator housing, an inlet side of said screen being positioned to receive fluid from said deflector tube, an outlet side of said screen being in fluid flow communication with said at least one ejection port.

6. An apparatus for removing milling debris from a well bore during milling operations, said apparatus comprising:

a tubular separator housing, said separator housing being connectable to a lower end of a rotating work string;

a milling tool connectable to a lower end of said separator housing;

at least one fluid ejection port through a wall of said separator housing, said at least one ejection port being positioned and adapted to eject fluid to an area of a well bore adjacent said separator housing;

at least one intake port on said milling tool, said at least one intake port being positioned and adapted to take in debris-laden fluid from an area of a well bore adjacent said milling tool;

a screen within said separator housing, an inlet side of said screen being positioned to receive fluid taken in by said at least one intake port, an outlet side of said screen being in fluid flow communication with said at least one ejection port;

a debris deflector within said separator housing between said at least one intake port in said milling tool and said screen;

a downhole motor connected to said separator housing;

a surface pump at the well site for pumping fluid downhole through the workstring to said downhole motor, wherein said downhole motor is a fluid driven motor; and a downhole pump driven by said downhole motor, said downhole pump being positioned and adapted to pump debris-laden fluid from said at least one intake port in said milling tool, through said debris deflector, to said inlet side of said screen;

wherein said debris deflector comprises:

a deflector tube within said separator housing;

an inlet on said deflector tube connected in fluid flow communication with said at least one intake port in said milling tool;

an end cap on said deflector tube for deflecting debris; and at least one side port on said deflector tube for directing debris-laden fluid to an annular space between said deflector tube and said separator housing.

7. A method for removing milling debris from a well bore during milling operations, said method comprising:

providing a separator housing connected to a lower end of a work string, and a milling tool connected to a lower end of said separator housing, said separator housing containing a fluid ejection port, a downhole pump, and a debris deflector tube;

rotating said separator housing and said milling tool with said workstring to perform a downhole milling operation;

ejecting fluid with said downhole pump through said fluid ejection port to an area of a well bore adjacent said separator housing to entrain milling debris created by said milling tool;

drawing debris-laden fluid into an intake port on said milling tool, from an area of a well bore adjacent said milling tool, with said downhole pump; and conducting said debris-laden fluid through said debris deflector tube within said separator housing and back to said fluid ejection port.

* * * * *